United States Patent [19]

Cancellara

[11] Patent Number: 4,920,988

[45] Date of Patent: May 1, 1990

[54] SAFETY ASHTRAY

[76] Inventor: Enzo Cancellara, 1707A St. Clair Avenue West, Toronto, Ontario, Canada, M6N 1J2

[21] Appl. No.: 220,542

[22] Filed: Jul. 18, 1988

[30] Foreign Application Priority Data

Sep. 30, 1987 [CA] Canada ..... 548308

[51] Int. Cl.[5] ..... A24F 19/00; A24F 19/14

[52] U.S. Cl. ..... 131/242; 131/237; 131/240.1; 131/241

[58] Field of Search ..... 131/231, 235.1, 237, 131/240.1, 241, 242

[56] References Cited

U.S. PATENT DOCUMENTS

| | | | |
|---|---|---|---|
| D. 119,206 | 2/1940 | Sandejas | 131/242 |
| 1,550,731 | 8/1925 | Marshall | 131/242 |
| 1,999,090 | 4/1935 | Dube | 131/240.1 |
| 2,950,721 | 8/1960 | Aghnides | 131/242 |
| 4,427,016 | 1/1984 | Orter | 131/241 X |
| 4,726,513 | 2/1988 | Wolfe | 131/242 X |

FOREIGN PATENT DOCUMENTS

| | | | |
|---|---|---|---|
| 0642096 | 1/1962 | Canada | 131/240.1 |
| 1241778 | 8/1960 | France | 131/240.1 |
| 0515901 | 12/1939 | United Kingdom | 131/240.1 |

*Primary Examiner*—V. Millin
*Assistant Examiner*—Joe H. Cheng

[57] ABSTRACT

The present invention provides a safety ashtray comprising an outer shell and an inner rest within the shell. The rest has an upwardly inwardly tapering outer surface with a series of guides for guiding generally upright positioning of a cigarette fitted into any of the guides so as to burn downwardly along the rest into the shell.

5 Claims, 3 Drawing Sheets

SAFETY ASHTRAY

FIELD OF THE INVENTION

The present invention relates to a safety ashtray for receiving a cigar or cigarette in a manner so as to burn downwardly into the ashtray.

BACKGROUND OF THE INVENTION

A standard ashtray includes a small upward sidewall with a number of horizontally extending recessed regions at the upper edge of the sidewall. These recessed regions are used to seat a cigar or cigarette in a generally horizontally extending position with the burning end located within the ashtray and the filter or smoking end sitting somewhere outside the ashtray. Initially, the balancing of the cigar or cigarette does not present any problems. However as it burns down the balancing changes whereby the cigar or cigarette if left unattended for any significant period of time, will actually lever or topple to the outside of the ashtray. This is well evidenced by burn marks often found on table tops. Furthermore, cigarettes falling out of ashtrays as they have burned down have in fact resulted in house and building fires.

SUMMARY OF THE PRESENT INVENTION

The present invention provides a safety ashtray designed to minimize the possibility of a cigarette falling out of the ashtray. More particularly, the safety ashtray of the present invention comprises an upwardly inwardly angled cigarette rest with deflecting means to cause a cigarette, if placed improperly in the ashtray to deflect onto the rest. The rest itself includes guide means for generally upright positioning of the cigarette so as to burn downwardly along the rest and into the ashtray.

As a result of the upward inward angling of the rest and the deflecting means, it is essentially impossible to place a cigarette in the ashtray such that burning of the cigarette will allow it to fall out of the ashtray.

BRIEF DISCUSSION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
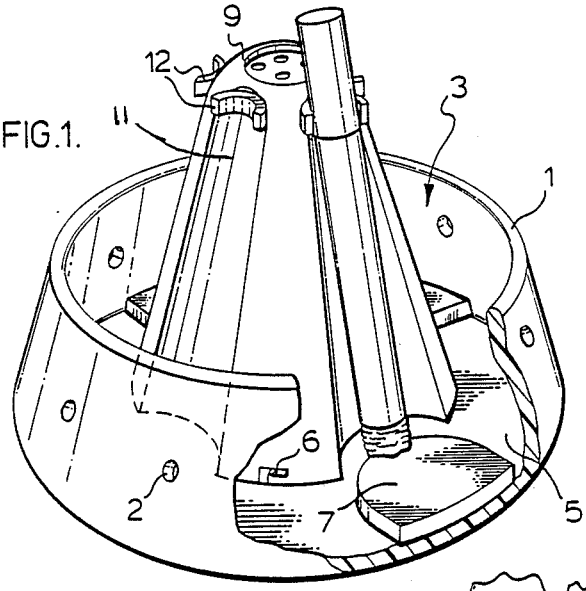
FIG. 1 is a top perspective view showing in partial section a safety ashtray according to a preferred embodiment of the present invention.

FIG. 1 shows an ashtray formed from an outer shell having a sidewall 1 extending upwardly from a solid bottom 5 with an open top generally indicated at 3 into the shell. Provided interiorly of the shell is a cigarette rest 9.

Figure 2:
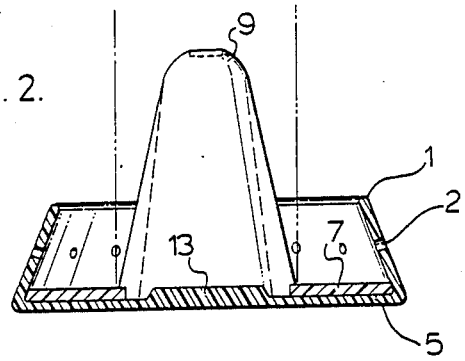
FIG. 2 is a side section view of the ashtray of FIG. 1.

As best seen in FIG. 2, rest 9 has an outer surface which is angled inwardly from top to bottom of the outer surface, i.e. the outer surface is upwardly, inwardly angled and in the particular embodiment shown the rest itself has a generally conical configuration. Extending upwardly along the side of rest 9 are a plurality of recessed regions 11. These recessed regions provide cigarette guides for guiding the generally upright positioning of or cigarette fitted in any of the guides.

The safety feature of the ashtray of the present invention is clearly apparent from the drawings which show how a cigarette fitted into one of the guides or recessed regions 11 burns downwardly into the ashtray along the rest. Note that the bottom wall 5 of the shell includes thickened or reinforced regions 7 at the base of each of the recessed regions 11 to prevent the lighted end of the cigarette from burning completely through the shell. Typically, the ashtray will be made from plastic material with the reinforced regions 7 being made from a flame or burn resistant material.

It will also be noted from FIG. 2 of the drawings that with the interior cigarette rest or cone 9 being taller than the sidewall 1 of the shell, there is no tendency to attempt to place the cigarette across the top of the ashtray thereby preventing its use in a standard non-safe manner.

By setting the outer sidewall of the shell at an upward inward angled similar to that of the conical rest, there is a relatively limited gap between the sidewall and the rest preventing the cigarette from toppling over into the ashes within the shell. Therefore the smoking or filter end of the cigarette cannot fall down into the ashes until the cigarette has been completely burned.

By giving the centrally located rest 9 a downwardly expanding conical configuration and by providing guide regions around its outer surface the lighted ends of two or more cigarettes placed in separate guides are isolated from one another so that the burning of one cigarette does not affect any other cigarette leaning on the rest. Accordingly, one can put his or her cigarette out and leave it in the ashtray without worrying about it being relit by any of the other cigarettes in the ashtray.

In the particular embodiment best shown in FIG. 2 of the drawings the interior rest 9 is press fitted to the bottom of the exterior shell onto an upwardly extending lug or tab 13 preventing shifting of the rest within the ashtray. It is then locked in position by means of twist fit bayonet lock 6. For cleaning purposes, rest 9 can simply be twisted and pulled or lifted off of the tab providing complete access to the interior of the outer ash collecting shell.

According to a further preferred feature, the rest is additionally provided with cigarette clips 12, one of which can be seen in FIG. 1. These clips act as spacing elements to prevent the filter of the cigarette from contacting the main body of te rest where there could be a dirt buildup and therefore provide a further clean feature to the ashtray.

According to still a further preferred embodiment of the present invention, the outer shell is provided with a plurality of vent holes 2 which allow escape of smoke from the bottom of the ashtray outwardly through the sidewall rather than all of the smoke having to pass upwardly through the top opening in the shell.

It will now be apparent from the description above how the safety ashtray of the present invention is setup to locate or cigarette in a position where it always remains to the inside of the ashtray making it virtually foolproof. Even as the cigarette burns down it will remain trapped within the outer shell in a safe burning position.

Figure 3:
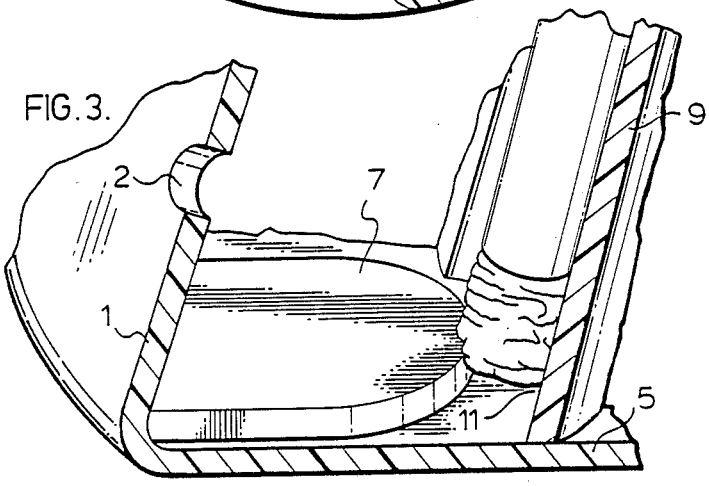
FIG. 3 is a enlarged side sectional view of the bottom region of the ashtray of FIG. 1.
Figure 4:
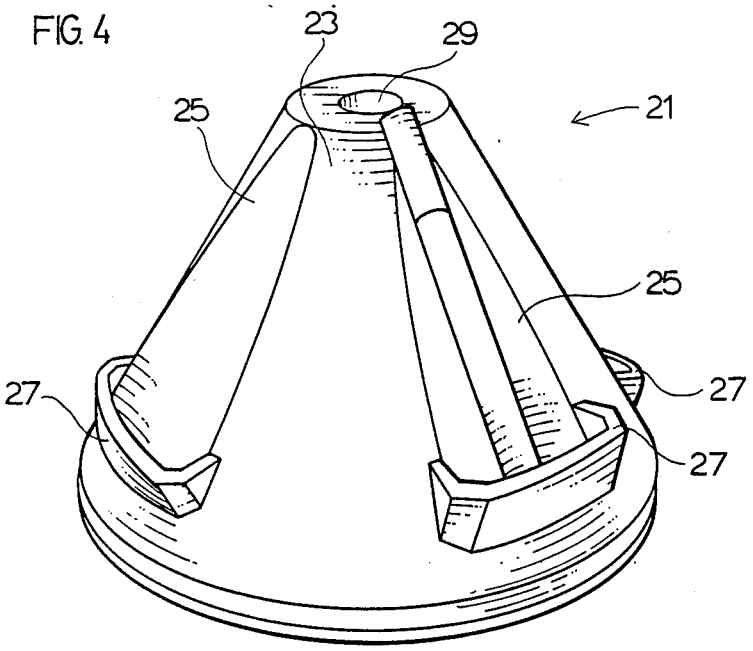
FIG. 4 is a perspective view of a safety ashtray according to a further preferred embodiment of the present invention
Figure 5:
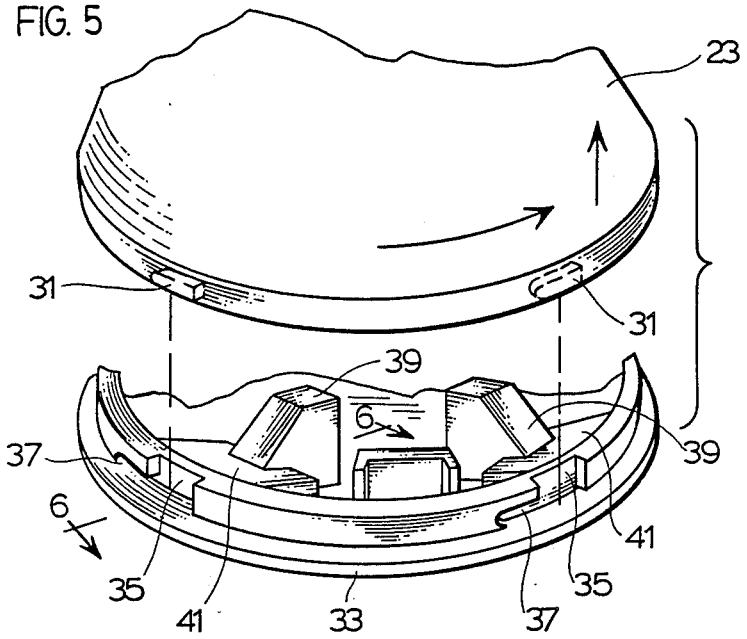
FIG. 5 is an exploded perspective view of the lower end of the safety ashtray shown in FIG. 4.
Figure 6:
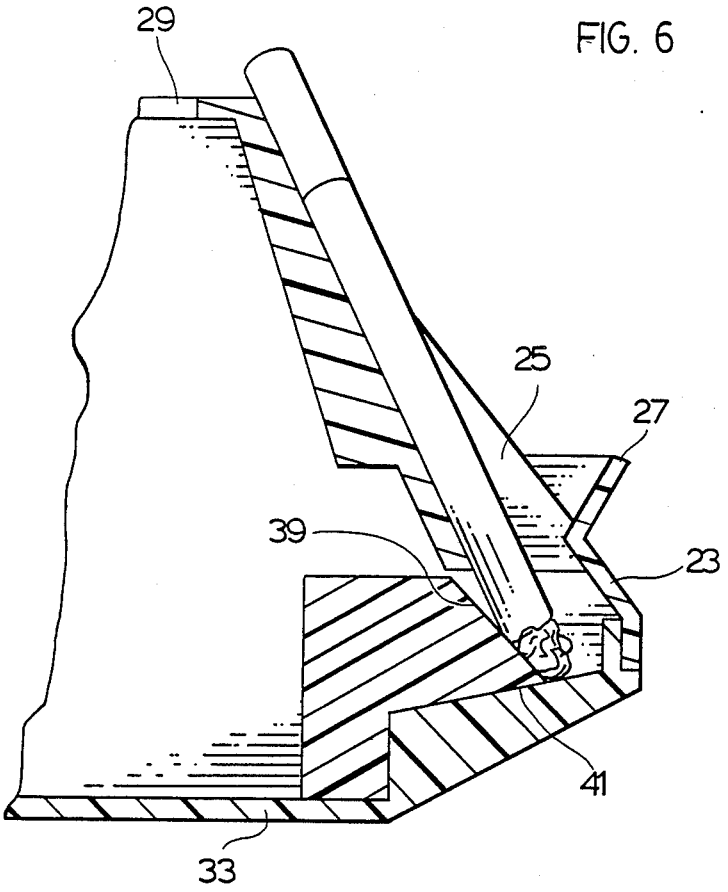
FIG. 6 is a sectional view through a side region of the safety ashtray of FIG. 4

The description above with respect to FIGS. 1 through 3 refers to a safety ashtray having an outer shell and an inner rest within the shell. FIGS. 4 through 6 of the drawings show a safety ashtray 21 having the same safety features and operating in the same manner as the ashtray shown in FIGS. 1 through 3 but formed as a rest with small pockets rather than a larger outer shell. In particular ashtray 21 comprises an upwardly inwardly angled body part 23 having a plurality of dished regions 25 around its circumference. Each one of these dished regions as can be seen widens downwardly past a small lip 27 defining a cigarette pocket. The dished region as can be best seen in FIG. 6 of the drawings, in fact continues well downwardly into the ashtray past lip 27. The key to ashtray 21 as was the key to the ashtray described in FIGS. 1 through 3 is the upward inward angling of the rest surface on body part 23 for the cigarette and the use of means for deflectiong the cigarette onto the rest surface. In the earlier embodiment, the shell will deflect the cigarette back onto the center cigarette rest. In this case the deflecting means is in the form of the lip 27 which is angled upwardly and outwardly away from the rest and spaced at a sufficient distance from its outer surface and the dished region 25 of that surface such that a cigarette placed improperly to the inside surface of the lip will automatically tip back to the FIGS. 4 and 6 position and slide down into the interior or pocket of the ashtray with the burning end down. Therefore, lip 27 acts as a guide to assist in proper positioning of the cigarette. It cannot be used as a cigarette rest itself.

Ashtray 21 has a two piece construction including a bottom piece 33 removable from the top piece 23. This is best shown in FIG. 5 of the drawings where the upper body part 23 is provided with lugs 31 which lock in bayonet type openings 35 having undercut portions 37. The two pieces of the ashtray are then assembled and disassembled by a twisting motion as shown.

When in the assembled position, each of the dished regions 25 sits immediately over seating surfaces 39 that once again guide the downward burning of the cigarette as shown in FIG. 6 of the drawings. Each of the seating surfaces 39 is set at a downward outward angle as shown and meets at its lower end with a downwardly inwardly angled surface 41 at the bottom of the pocket. The downward inward inclination of surface 41 causes the ashes, after they have burned from the cigarette, to simply slide down into the center of the bottom piece 33. In addition, any butts dropped into the cigarette pockets will fall onto surface 41 and then simply roll to the interior of the ashtray. The bottom piece 33 can then be removed from the upper part 23 for an easy and efficient cleaning.

The upward inward angling of dished regions 25 is set such that smoke from the lower burning end of the cigarette which typically rises straight upwardly is outside of and does not affect the remainder of the cigarette. This avoids darkening or burning of the body of the cigarette which might otherwise occur if the cigarette were in line with the updrafting of the smoke.

By giving the dished regions 25 a downward widening there is an increased area at the bottom of the dished region for placement of the burning end of the cigarette into the pocket of the ashtray. At the same time, the upper narrow end of the dished region acts particularly when the cigarette is at full length as shown in FIG. 1 as a guide for proper upright positioning of the cigarette.

A further feature of ashtray 21 is the provision of a center hole 29 in the upper part 23 of the ashtray. This center hole opens directly to the center of the bottom part 33 of the ashtray and provides a butt drop for the cigarettes after they have been finished. Again, the butts along with the ashes are easily cleaned from the ashtray by simply removing the bottom from the top piece of the ashtray.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A safety ashtray comprising a cigarette rest with an outer surface set an upward inward angle, a plurality of dished regions in said outer surface of said cigarette rest, said dished regions guiding generally upright positioning of a cigarette placed therein so as to burn downwardly along said rest, each of said dished regions having a widened lower end bordered by a deflecting lip to cause a cigarette placed in said ashtray to deflect onto said rest and defining a cigarette receiving pocket at said widened lower end of each of said dished regions.

2. A safety ashtray as claimed in claim 1, wherein said deflecting lip is set at an upward outward angle away from the lower end of said dished region, said dished region extending downwardly into said pocket past said deflecting lip.

3. A safety ashtray as claimed in claim 1, said pocket including a downwardly inwardly angled bottom surface for guiding ashes burnt from the cigarette and butts placed in said pocket to fall interiorly of said ashtray.

4. A safety ashtray as claimed in claim 1, having a two-piece construction comprising an upper piece and a bottom piece, said bottom piece being removable from said upper piece for interior cleaning of said ashtray, said upper piece including an opening for cigarette butts to fall to said bottom piece.

5. A safety ashtray as claimed in claim 4, wherein said butt opening comprises a central top opening within said upper piece.

* * * * *